US008936077B2

(12) United States Patent
Jiral

(10) Patent No.: US 8,936,077 B2
(45) Date of Patent: Jan. 20, 2015

(54) REMOVABLE INSERT FOR FORMATION OF A RECESS IN A TUBULAR BY EXPANSION

(75) Inventor: Dennis G. Jiral, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 686 days.

(21) Appl. No.: 12/959,131

(22) Filed: Dec. 2, 2010

(65) Prior Publication Data

US 2012/0138313 A1 Jun. 7, 2012

(51) Int. Cl.
*E21B 23/00* (2006.01)
*B21D 39/08* (2006.01)

(52) U.S. Cl.
USPC ..... 166/207; 166/242.1; 72/370.06

(58) Field of Classification Search
USPC ..... 166/381, 384, 206, 207, 242.1; 72/370.06, 208, 209, 283
See application file for complete search history.

(56) References Cited

U.S. PATENT DOCUMENTS

| | | | | |
|---|---|---|---|---|
| 5,577,925 | A * | 11/1996 | Schnatzmeyer et al. | 439/191 |
| 7,363,691 | B2 * | 4/2008 | Cook et al. | 29/523 |
| 7,661,481 | B2 | 2/2010 | Todd et al. | |
| 7,690,436 | B2 | 4/2010 | Turley et al. | |
| 7,703,511 | B2 | 4/2010 | Buyers et al. | |
| 2007/0221374 | A1 * | 9/2007 | Filippov et al. | 166/207 |
| 2009/0205839 | A1 * | 8/2009 | Cook et al. | 166/382 |
| 2010/0038076 | A1 * | 2/2010 | Spray et al. | 166/207 |

* cited by examiner

*Primary Examiner* — Catherine Loikith
(74) *Attorney, Agent, or Firm* — Steve Rosenblatt

(57) ABSTRACT

A material that dissolves or disintegrates is secured to an inside surface of tubular goods before swaging or expansion takes place. The material remains in position as the swaging occurs and post expansion is removed leaving a recess of a desired shape to function for a variety of purposes depending on its shape and location. At the end of a tubular it can serve as a bell into which the next string is expanded for a monobore completion. In other locations in a tubular it can function as a landing collar for a variety of tools. It can also function as a seal bore as the added material is removed preferably with water. The preferred material is an alloy of aluminum, tin and zinc.

22 Claims, 1 Drawing Sheet

REMOVABLE INSERT FOR FORMATION OF A RECESS IN A TUBULAR BY EXPANSION

FIELD OF THE INVENTION

The field of the invention is a method of producing a recess in a tubular using expansion and more particularly where a fixed swage accomplishes the expansion and creation of the recess by displacing an insert that can later be removed, preferably by dissolving the insert.

BACKGROUND OF THE INVENTION

Removing downhole barriers by dissolving them is a concept illustrated in U.S. Pat. Nos. 7,690,436; 7,661,481 and 7,703,511. Materials that dissolve or disintegrate in water are known such as aluminum alloys which are about 50% aluminum, 40% tin and 10% zinc are known and used for metal wire and sold by Praxair subsidiary TAFA Incorporated. This material is known to dissolve or disintegrate in water and is called 300/301—Dissolvable Metal Wire on the Material Safety Data Sheet provided by Praxair.

Producing a bell in a tubular was in the past accomplished with a variable swage that could form the bell at the bottom of a tubular being expanded and then be reconfigured to another size for further expansion of the balance of the tubular or for removal from the tubular. Adjustable swages are fairly complex devices so they always presented some risk of mechanical malfunction when switching dimension.

What is needed and provided by the present invention is a method to make a bell or recess in a tubular that can have a variety of purposes and accomplishing the formation of such a bell or recess with a swage that operates at preferably a single dimension. The method involves the use of a material that dissolves or disintegrates with exposure to a material such as water and yet has the strength to remain in position as a swage passes by the material so that the presence of the material is used to enhance the enlargement of the tubular where the material is disposed during the expansion. After the expansion the material is simply removed with an appropriate material such as water, for example, and there remains a zone of enlarged diameter which can be a bell at the bottom of a tubular or a recess if disposed at another location along the length of the tubular. Thereafter the presence of a bell can be used to secure another tubular into the bell and retain the internal dimension of the tubular above into the newly expanded tubular. If there is a recess produced in a given tubular the recess can be used as a locating groove for landing other tools at a predetermined location.

Other variations are envisioned such as protective sleeves such as for highly polished seal bores, no-goes for other tools and ball seats among other applications. The common theme to the various applications is the use of a simple swage and the ease of removal of the material after the swage moves through it. In the preferred embodiment the aluminum alloy made by TAFA is preferred as it is simply removed in the presence of water. Coatings on the material can also be employed that are then removed by the swage or through other means before or during the expansion. While a swage is recited to accomplish the expansion, various other devices can be used to expand a tubular shape such as extendable rollers from a housing or spaced seals that have pressure applied between them or other devices that can increase the dimension of one or more tubulars. Those skilled in the art will better understand the invention form a review of the description of the preferred embodiment and the associated drawings while recognizing that the full scope of the invention is given by the appended claims.

SUMMARY OF THE INVENTION

A material that dissolves or disintegrates is secured to an inside surface of tubular goods before swaging or expansion takes place. The material remains in position as the swaging occurs and post expansion is removed leaving a recess of a desired shape to function for a variety of purposes depending on its shape and location. At the end of a tubular it can serve as a bell into which the next string is expanded for a monobore completion. In other locations in a tubular it can function as a landing collar for a variety of tools. It can also function as a seal bore as the added material is removed preferably with water. The preferred material is an alloy of aluminum, tin and zinc.

BRIEF DESCRIPTION OF THE DRAWINGS

FIGS. 1 and 1*a* are respectively and alternatively a run in position with the material located at the lower end of a tubular or above the lower end of a tubular and the swage in position for expansion of the tubular;

FIG. 2 is the view of FIG. 1 showing how the placement of the material helps to create a bell at the tubular lower end as the swage passes through;

FIG. 3 is the view of FIG. 2 showing the material removed to expose the bell at the lower end of the tubular.

FIG. 4 is a view showing discrete profiles and a schematically represented tool and latch profile that is designed to engage a specific profile on the surrounding tubular.

DETAILED DESCRIPTION OF THE PREFERRED EMBODIMENT

Figures 1, 1A, 2, 3, 4:
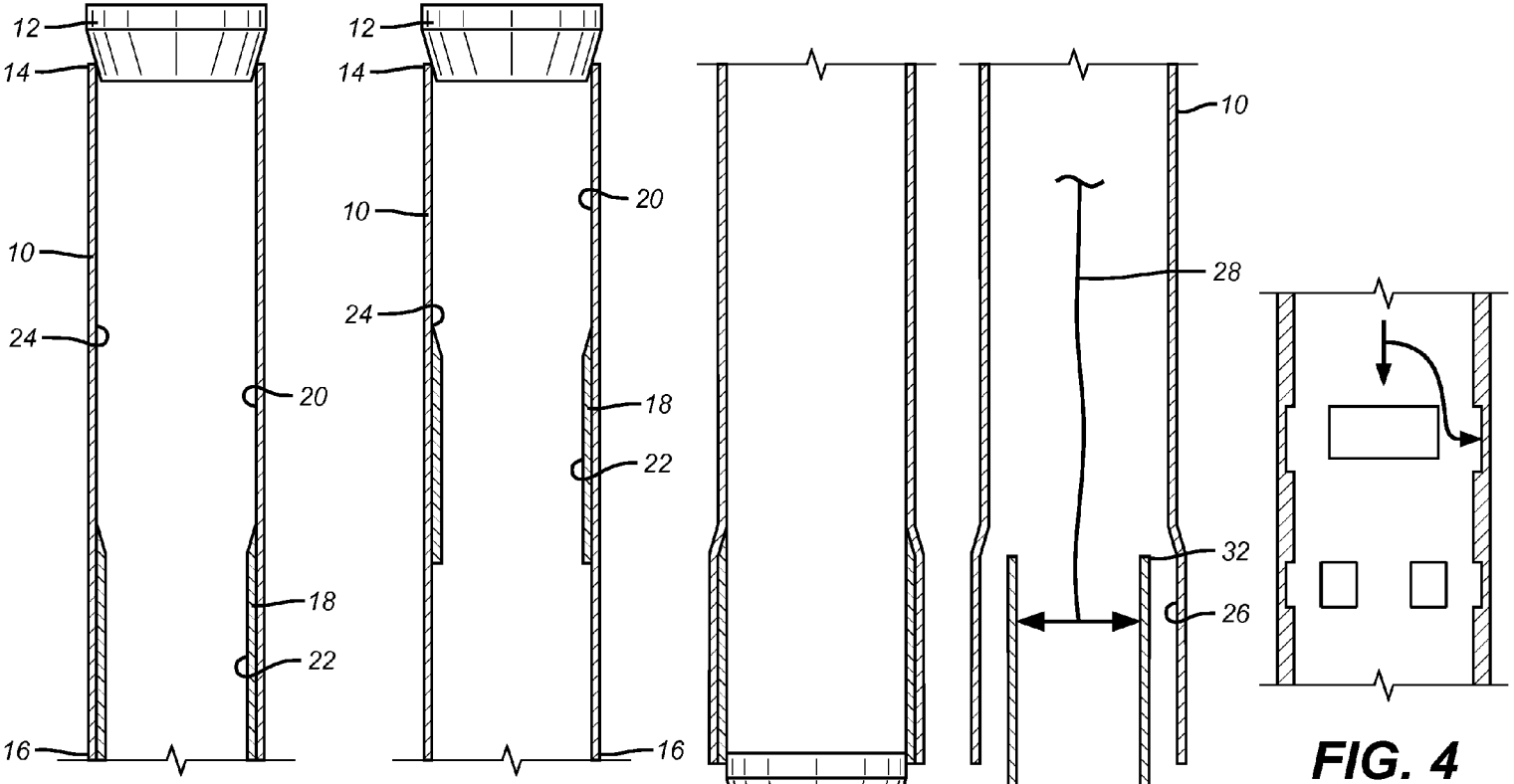

FIG. 1 illustrates a tubular 10 that optionally has the schematically illustrated swage 12 at the top 14 of the tubular 10. The expansion as illustrated in FIG. 1 will go from top to bottom but can just as well proceed in the reverse direction from bottom 16 to the top 14. While the swage 12 is schematically illustrated as a fixed dimension cone, which is preferred, other techniques for expanding the tubular are contemplated including adjustable swage or swages, spaced opposed packer cups with pressure admitted between the packer cups or hydraulically extendable rollers from a housing that is then rotated from the surface or with a motor on the tubular string that supports the housing.

Also shown in FIG. 1 is an insert material 18 that is located adjacent the end 16 and is in the shape of a cylinder lining the inside wall 20 of the tubular 10. The material is preferably a metal alloy that can be readily removed without needing to by physically retrieved. In the preferred form the material is dissolved or disintegrated after the swage 12 passes through it or the expansion of the tubular 10 is completed by some other technique. Also in the preferred embodiment the material 18 is removed by the presence or introduction of water regardless of its temperature. A metallic alloy of aluminum combined with tin and zinc is preferred. The proportions can ideally be about 50% aluminum, 40% tin and 10% zinc. The alloy behaves as a metal and can be secured to the wall 20 by welding, brazing or adhesives to name a few options.

A coating 22 can be applied to the exposed portions of the material 18 so that it can be protected from the presence of water or any material that would initiate the dissolving or disintegration process prematurely. The act of expansion, such as with the swage 12, can also strip away some or all of the coating so that the dissolving or disintegration process can take place. Alternatively, the coating 22 can be removed after the expansion with a material introduced into the tubular 10 or by changing well conditions in the tubular 10 so that the protective coating 22 is removed. Some options for non-mechanical removal of the coating can be the introduction of fluids that remove the coating 22 but that do not act on the material 18. Adding heat is another option.

While the material 18 is shown in a cylindrical shape whose lower end is adjacent the end 16 of the tubular 10, those skilled in the art will recognize that the location of such a cylindrical shape can be shifted up and away from the lower end 16 to another location such as 24, see also FIG. 1*a* where the material 18 can also be secured to the wall 20 in the optional variations described above. If using a pressure technique for expansion such as with an inflatable or with spaced packer cups for example, the material 18 can be cylindrically shaped and sealed to the inside wall 20 of the tubular 10 so that the applied pressure to a zone inside the tubular 10 that is longer than the sleeve of material 18 can create a recess at one or both ends of the material 18 as the presence of the material strengthens a portion of the tubular 10 so that it resists expansion. Thereafter, the material is removed and the original inside diameter under it is maintained, while a recess is formed on one or both ends of the former location for the material 18. One or more landing locations for another tool can then be developed in conjunction with use of material 18 to latch another tool into the recess so created.

When located as shown in FIG. 1 the net result of the method is to produce an open ended bell 26 at the lower end 16 without milling so that a running string such as 28 can deliver another string 30 through the now expanded string 10 such that the upper end 32 of string 30 is aligned with the bell 26, whereupon expansion of the string 30 will secure it to the bell 26 so that the inside diameter at 34 after string 30 is expanded will be at least as large as the expanded diameter of string 10 at location 24 with the string 30 expanded at its upper end 32 into supporting and ultimately sealing contact with string 10. The supporting and sealing can occur in stages to leave openings for fluid displacement if there will be cementing of string 30 after it is expanded. When the cementing is concluded the expansion of string 30 within bell 26 can be concluded for a sealing contact so that the net result is a monobore completion.

While the material 18 is shown in a cylindrical shape whose lower end is adjacent the end 16 of the tubular 10, those skilled in the art will recognize that the location of such a cylindrical shape can be shifted up and away from the lower end 16 to another location such as 24 where the material 18 can also be secured to the wall 20 in the optional variations described above. If using a pressure technique for expansion such as with an inflatable or with spaced packer cups for example, the material 18 can be cylindrically shaped and sealed to the inside wall 20 of the tubular 10 so that the applied pressure to a zone inside the tubular 10 that is longer than the sleeve of material 18 can create a recess at one or both ends of the material 18 as the presence of the material strengthens a portion of the tubular 10 so that it resists expansion. Thereafter, the material is removed and the original inside diameter under it is maintained, while a recess is formed on one or both ends of the former location for the material 18. One or more landing locations for another tool can then be developed in conjunction with use of material 18 to latch another tool into the recess so created, as shown in FIG. 4.

As another option the material 18 can cover a polished surface that is protected during the expansion and then is exposed after the expansion concludes so that another tool with a seal can be engaged with the polished surface. As yet another option the material 18 may be in an already formed bell so that its internal dimension is not smaller than the unexpanded internal diameter of the tubular 10 before expansion starts. When the material 18 is then removed the bell inside surface is exposed. This can be useful for protection of the inside surface of a bell such as 26 during cementing followed by exposing the inside bell surface after cementing and optionally expansion. The material 18 protects the inside surface of the bell 26 until the material 18 is dissolved or disintegrated or otherwise made to disappear without being physically removed in the state that it was applied to the surface. As another option the length of the string 10 for all or some of its joints can be lined with the material 18 so that the presence of material 18 enhances the expansion that is accomplished with a given dimension of a fixed swage after the material is removed by dissolving or disintegrating or other means that do not involve retrieval to the surface in the form that it was when inserted into the bore. The insert material can be a continuous tube that has no connections and can also be produced as a seamless tube that can span the string and the connections that are in it for the expansion process.

The above description is illustrative of the preferred embodiment and many modifications may be made by those skilled in the art without departing from the invention whose scope is to be determined from the literal and equivalent scope of the claims below.

I claim:

1. A method of creating a profile in a first tubular comprising:

covering a lower end of an interior wall of the first tubular, said interior wall comprising a uniform diameter at and above said lower end of said first tubular, with a material secured to said interior wall while leaving a passage defined by a uniform interior diameter over the length of said material fully open;

expanding said material and said interior wall of said tubular adjacent said lower end with a swage driven toward and through said open passage to expand said interior wall and then said material to create an open-ended recess into which a second tubular can be located and expanded without reducing a drift dimension of said first tubular and without milling;

reconstituting said material to release said material from said now expanded wall;

exposing said previously covered lower end portion of said wall by said reconstituting;

positioning said second tubular to the now exposed but previously covered lower end portion of said wall;

attaching said second tubular to said first tubular at said lower end by expansion of said second tubular.

2. The method of claim 1, comprising:

accomplishing said reconstituting by dissolving or disintegrating said material.

3. The method of claim 2, comprising:

using water for said dissolving or disintegrating.

4. The method of claim 1, comprising:

expanding said material through said passage to enlarge at least a portion of said first tubular to a greater dimension than another portion of said first tubular where said material is not present during tubular expansion.

5. The method of claim 4, comprising:

creating a bell at said lower end of said first tubular by initial placement of said material.

6. The method of claim 4, comprising:

placing a bell at the lowermost tubular of a first tubular string;

aligning an upper end of said second tubular with said bell;

expanding said second tubular into a supporting relation to said bell.

7. The method of claim 6, comprising:

creating a monobore with said expanded first and second tubulars.

8. The method of claim 6, comprising:

allowing fluid to pass between said first and second tubulars with said second tubular supported in said bell;

sealing said second tubular in a surrounding annular space;

sealing said second tubular to said bell after sealing said surrounding annular space.

9. The method of claim 4, comprising:

providing a string made of said connected first or second tubulars and having at least one end;

expanding material through said passage therethrough at at least one location in said string away from said ends of said string;

locating a tool in at least one profile created after removal of said material.

10. The method of claim 9, comprising:

creating a plurality of unique profiles in said string;

supporting discrete tools at different profiles based on a match of a latch device on a tool with one of said profiles.

11. The method of claim 10, comprising:

creating said unique profiles by variation of shape, orientation or circumferential spacing of shapes that constitute said profiles.

12. The method of claim 9, comprising:

sealing the tool in said profile.

13. The method of claim 4, comprising:

covering said material in said passage;

removing said covering with a swage that expands said passage.

14. The method of claim 4, comprising:

using an aluminum alloy as said material.

15. The method of claim 14, comprising:

using a metallic alloy comprising aluminum, tin and zinc as said material.

16. The method of claim 15, comprising:

making said alloy about 50% aluminum, 40% tin and 10% zinc.

17. The method of claim 5, comprising:

using a fixed dimension swage run in either one of two opposed directions for said expanding.

18. The method of claim 4, comprising:

using a plurality of swages of different dimensions or at least one adjustable swage to perform said expanding.

19. The method of claim 1, comprising:

pumping a sealing material through said passage as said downhole operation.

20. The method of claim 1, comprising:

covering a polished bore on the wall of said tubular with said material.

21. The method of claim 1, comprising:

using pressure to perform said expanding;

applying said pressure to a zone of the tubular longer than the portion covered by said material;

creating a profile in the zone of the tubular not covered by said material;

retaining at least an original tubular inside dimension where said material was located before its removal.

22. The method of claim 21, comprising:

sealing the material to the tubular to prevent pressurizing the tubular in an annular space between said material and said tubular.

* * * * *